US006264304B1

(12) United States Patent
Iwaya et al.

(10) Patent No.: US 6,264,304 B1
(45) Date of Patent: Jul. 24, 2001

(54) INK JET RECORDING APPARATUS AND METHOD

(75) Inventors: Satoshi Iwaya; Atsushi Nishioka; Naoki Kobayashi, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/354,119

(22) Filed: Jul. 15, 1999

(30) Foreign Application Priority Data

Jul. 15, 1998 (JP) ..... 10-201010

(51) Int. Cl.[7] ..... B41J 23/00
(52) U.S. Cl. ..... 347/37; 347/39; 347/23
(58) Field of Search ..... 347/37, 39, 22, 347/23, 29, 30, 31, 32

(56) References Cited

U.S. PATENT DOCUMENTS

| | | | | |
|---|---|---|---|---|
| 4,177,471 | | 12/1979 | Mitchell | 347/37 |
| 4,551,736 | | 11/1985 | Suzuki et al. | 347/32 |
| 4,695,851 | | 9/1987 | Terasawa | 347/30 |
| 4,739,847 | | 4/1988 | Terasawa | 347/19 |
| 4,967,204 | * | 10/1990 | Terasawa et al. | 347/23 |
| 5,359,358 | | 10/1994 | Shimamura et al. | 347/9 |
| 5,426,456 | * | 6/1995 | Kuelzer et al. | 347/30 |
| 5,781,207 | * | 7/1998 | Hasegawa et al. | 347/23 |
| 6,189,997 | * | 2/2001 | Kanome et al. | 347/23 |

FOREIGN PATENT DOCUMENTS

| | | |
|---|---|---|
| 59-222360 | 12/1984 | (JP) . |
| 60-178063 | 9/1985 | (JP) . |
| 63-011347 | 1/1988 | (JP) . |
| 83-009548 | 1/1988 | (JP) . |
| 8-267774 | 10/1996 | (JP) . |

* cited by examiner

*Primary Examiner*—John E Barlow, Jr.
*Assistant Examiner*—Blaise Mouttet
(74) *Attorney, Agent, or Firm*—Nixon & Vanderhye P.C.

(57) ABSTRACT

The invention features a method and apparatus for an ink jet recording apparatus in which a carriage lock is provided. When a return of the carriage to the home position HP is detected, the waiting time at the home position HP is counted. When this waiting time has reached a predetermined time, a carriage lock is engaged. When the carriage lock is engaged immediately after the carriage returns to the home position HP, the frequency of the carriage lock is reduced, thus enhancing its durability. Further, there is no need of disengaging the carriage lock at a restart of the printing, thus improving responsiveness at the restart of the printing.

13 Claims, 5 Drawing Sheets

INK JET RECORDING APPARATUS AND METHOD

BACKGROUND OF INVENTION

1. Field of Invention

This invention related to an ink jet recording apparatus and method, and more particularly to an ink jet recording apparatus with a carriage lock mechanism and a method for controlling the same.

2. Related Art

Typically an ink jet recording apparatus has a recording head which moves along a sheet of recording paper by means of a carriage, ejecting ink drops thus printing on the surface of the recording paper. Often times during printing, the carriage will be put into a waiting condition and be placed in a home position away from the printing area. While the carriage carrying the recording head is under a printing waiting condition, it moves to a predetermined home position which is located off the recording area and waits for a printing command at the home position.

Although the carriage driving mechanism applies a brake force to keep the carriage in its home position, exterior vibrations may move the carriage toward the recording area while the carriage is waiting in the home position. Furthermore, when electric power is turned off, the carriage may be able to freely move, and there is a risk that the carriage may move toward the recording area from the home position.

In order to prevent unwanted movement of the carriage, an ink jet recording apparatus is often provided with carriage lock mechanisms for mechanically fixing the carriage at the relevant home position. (For example, U.S. Pat. No. 4,695,851 and U.S. Pat. No. 4,739,847) These conventional carriage locking mechanisms are constructed in such a way that each time the carriage returns to the home position the carriage is locked. Since the driving frequency of the carriage lock mechanism is high, there are associated problems with keeping the carriage locked. One such problem is that the components of the carriage lock mechanism rapidly deteriorate.

Another problem exists when printing should be restarted immediately after a previous printing is finished, requiring the carriage lock to be disengaged. The result is decreased responsiveness of the carriage when restarting the printing.

It is desirable to have an ink jet recording apparatus which can prevent deterioration of the components caused by the carriage lock and decreased responsiveness when the printing restarts, by avoiding unnecessary carriage lock actions.

SUMMARY OF INVENTION

In general, in one aspect, the invention features an ink jet recording apparatus which includes a recording head for ejecting ink liquid drops, a carriage for carrying the recording head and adapted to translate between a recording area and a home position, a carriage lock mechanism for locking the carriage at the home position, a carriage controller for translating the carriage to the home position, a timer for measuring a waiting time during which the carriage translated by the carriage drive control part is at the home position, and a lock controller which allows the carriage lock mechanism and the carriage to be into a locked condition when the waiting time measured by the timer has reached or exceeded a predetermined time.

The carriage lock will not be effected even if the carriage has returned to the home position, unless the carriage is waiting at the home position for more time than a predetermined period. If a command for restarting a printing is issued during the time, the carriage can be immediately moved to the recording area. If the carriage lock is set simultaneously when the carriage has returned to the home position, the driving frequency of the carriage lock mechanism is reduced, and the deterioration of the components of the carriage lock mechanism can be reduced. In addition, since frequency of disengaging the carriage lock mechanism is low, the responsiveness at the restart of the printing will be improved.

Implementations may include a maintenance unit for restoring the relevant recording head by sucking ink from ink nozzles in the recording head and disposing it to the exterior, and head restoration requesting means for issuing a head restoration request by the maintenance unit. It is preferable that the carriage lock is instantly engaged when the head restoration request is issued, regardless of the time during which the carriage is waiting at the home position, to prevent the ink from leaking out by movement of the carriage during suction of the ink.

Since the printing action will not start immediately after the electric source of the apparatus is switched on, the carriage can be locked by actuating the carriage lock mechanism, regardless of the above-described waiting time.

Implementations may also include a detector for detecting that the carriage has moved to the home position so as to start a measurement of the waiting time by means of the timer, by referring to results of detection by the detector as a trigger.

In another aspect, the invention features a method for controlling the ink jet recording apparatus including translating a carriage from a home position to a recording area according to a printing command, translating said carriage to said home position after a printing is finished, measuring a waiting time during which said carriage stays at said home position, after translating said carriage to said home position after a printing is finished is conducted, actuating a carriage lock mechanism when said waiting time has exceeded a preset time, to switch said carriage into a locked condition.

Implementations may include interrupting measurement of said waiting time, on receiving the printing command again within said preset time, in the previous step of actuating a carriage lock mechanism when said waiting time has exceeded a preset time, to switch said carriage into a locked condition, and translating said carriage from said home position to said recording area.

Implementations may also include actuating said carriage lock mechanism regardless of said waiting time on receiving a head restoration request from an ink suction mechanism, thereby to switch said carriage into the locked condition.

The invention may provide one or more of the following advantages.

The carriage lock is not conducted until the preset waiting time expires since the carriage has returned to the home position, and the printing can be instantly restarted on receiving the command for restarting the printing within the period. Therefore, responsiveness for restarting the printing is better than with the conventional apparatus for which disengagement of the carriage lock must be awaited. Further, comparing with the conventional apparatus in which the carriage lock is conducted each time the carriage returns to the home position HP, the frequency of the carriage lock is low, and accordingly the deterioration of the components pertaining to the carriage lock can be restrained.

In addition, the carriage lock is conducted immediately after the electric power is applied, regardless of the waiting time, and so, the ink will not leak out to the exterior even if vibrations occur due to setting of a roll paper or a cartridge immediately after the application of the power.

Moreover, when the head restoration request is issued, the carriage lock is instantly conducted, thus enabling the ink suction operation to be conducted always in the locked condition. Therefore, this can avoid such disadvantages as the ink leaks out to the exterior as the carriage slides during the ink suction process.

Further details of an ink jet recording device and method suitable for use in further embodiments are disclosed in US application entitled "Ink Jet Recording Apparatus", assigned to the same assignee, Seiko-Epson Corporation, filed on the same date, and with priority based on Japanese Patent Application Hei 10-201009, filed Jul. 15, 1998.

The details of one or more embodiments are set forth in the accompanying drawings and the description below. Other features, objects, and advantages of the invention will be apparent from the description and drawings, and from the claims.

DETAILED DESCRIPTION OF THE PREFERRED EMBODIMENTS

Figure 1:
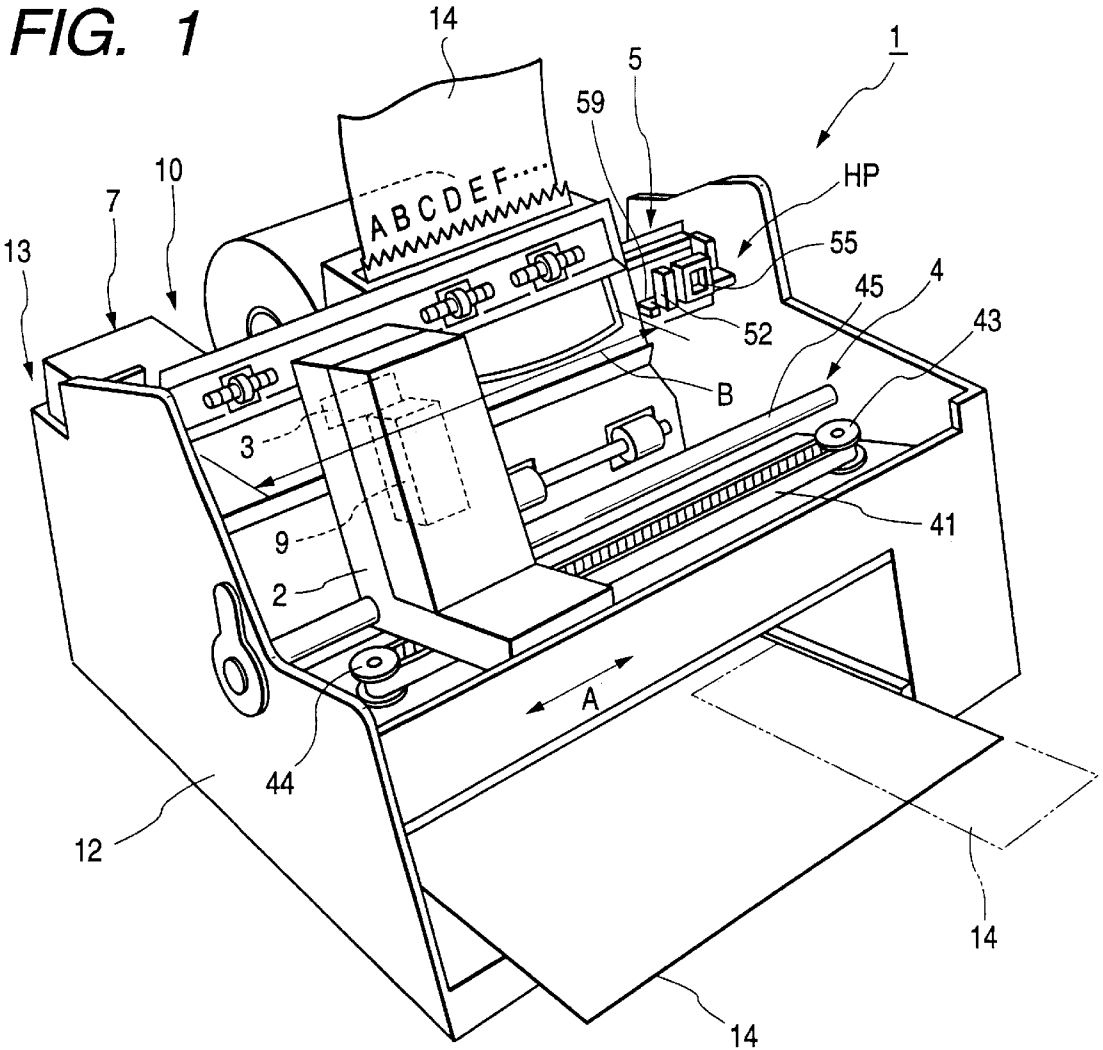
FIG. 1 is a perspective view of an implementation an ink jet recording apparatus.
Figure 2:
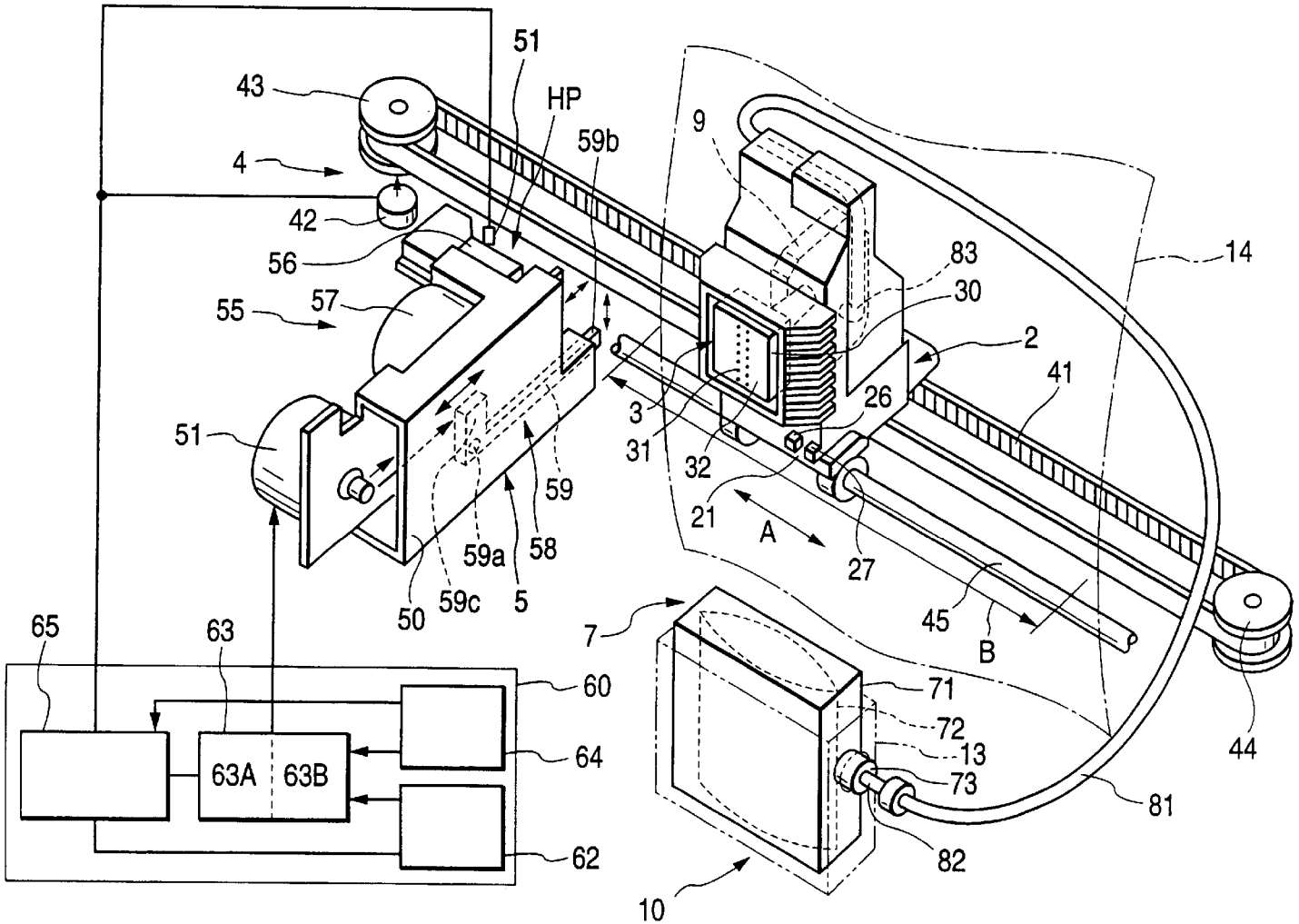
FIG. 2 is a perspective view showing a part of the apparatus as shown in FIG. 1.

FIG. 1 is a perspective view showing the ink jet recording apparatus of an embodiment according to the present invention, and FIG. 2 is a perspective view showing a part of the apparatus as shown in FIG. 1 as seen from the opposite side.

The ink jet recording apparatus 1 has a recording head 3 for ejecting liquid ink drops, and a carriage 2 carrying the recording head 3, a carriage driving mechanism 4 for driving the carriage 2 in a scanning direction as shown by an arrow A, and an ink supply mechanism 10 for supplying the recording head 3 with the liquid ink. The recording head 3 is provided with a nozzle forming face 32 which has a plurality of nozzles 31 for ejecting the liquid ink drops. This nozzle forming face 32 is exposed out of the rectangular opening 30 formed in the carriage 2.

The carriage driving mechanism 4 includes a guide shaft 45, a timing belt 41 stretched between a driving pulley 43 and a following pulley 44, and a carriage motor 42 for rotatably driving the driving pulley 43, as shown in FIG. 2. The lower face of the carriage 2 is slidably supported with respect to the guide shaft 45 and connected to the timing belt 41. When the timing belt 41 is driven by the carriage motor 42, the carriage 2 moves in the scanning direction A along the guide shaft 45.

While driving the carriage 2 in the scanning direction A, the ink supplied from the ink supply mechanism 10 is ejected in a form of liquid ink drops from the nozzles 31 of the recording head 3. A sheet of recording paper 14 is conveyed to the position confronting the nozzle forming face 32 (recording area B), and the ejected liquid ink drops print on a surface of the recording paper 14.

The ink supply mechanism 10 consists of an ink cartridge 7 detachably mounted on an ink cartridge mounting portion 13 formed on a apparatus body 12 of the ink jet recording apparatus 1, a pressure reducing unit 9 mounted on the carriage 2, and an ink supply tube 81 connected between the ink cartridge 7 and the pressure reducing unit (attenuator) 9.

The ink cartridge 7 is formed with a flexible ink bag 72 contained in a rigid case 71. An ink-supply needle 82 fitted to one end portion of the ink supply tube 81 is connected to an ink takeout port 73 fromed on the ink bag 72. The other end portion 83 of the ink supply tube 81 is connected to the pressure attenuator 9. Further, the leading end portion of an ink outlet path formed in the pressure attenuator 9 is connected to the recording head 3.

Consequently, the ink stored in the ink bag 72 of the ink cartridge 7 is supplied via the ink supply tube 81 to the pressure attenuator 9 before being sent to the recording head 3. Then the ink supplied to the recording head 3 is ejected from the ink nozzle 31.

A home position of the carriage 2 is provided at a position adjacent to the recording area B as shown by an arrow HP. A head maintenance unit 5 is arranged at a position confronting the home position HP. This head maintenance unit 5 is provided with an ink suction mechanism 55 and the carriage lock mechanism 58.

The ink suction mechanism 55 is provided with a cap 56 which covers the nozzle forming face 32 of the recording head 3 when the recording head 3 has moved to the home position HP. The cap 56 is at a retreated position at a side of a unit case 50 while the carriage 2 is moving in the recording area B.

Pressure is reduced inside the cap 56 by a pump 57 which is actuated by a motor 51 attached to the unit case 50. When the nozzle forming face 32 is covered with the cap 56, a head restoring process, such as sucking the ink as well as residual foam through the ink nozzles 31 and disposing them to the exterior, will be performed by operating the pump 57.

The carriage lock mechanism 58 is provided with a lock arm 59. A forward end 59*b* of the lock arm 59 projects forward from the unit case 50. A bent portion of the lock arm 59 is rotatably supported at the unit case 50 by a swinging center pin 59*a*. A rearward end 59*c* of the lock arm 59 is connected to the motor 51 by a link mechanism and a gear train (not shown) arranged in the unit case 50.

Figure 3A:
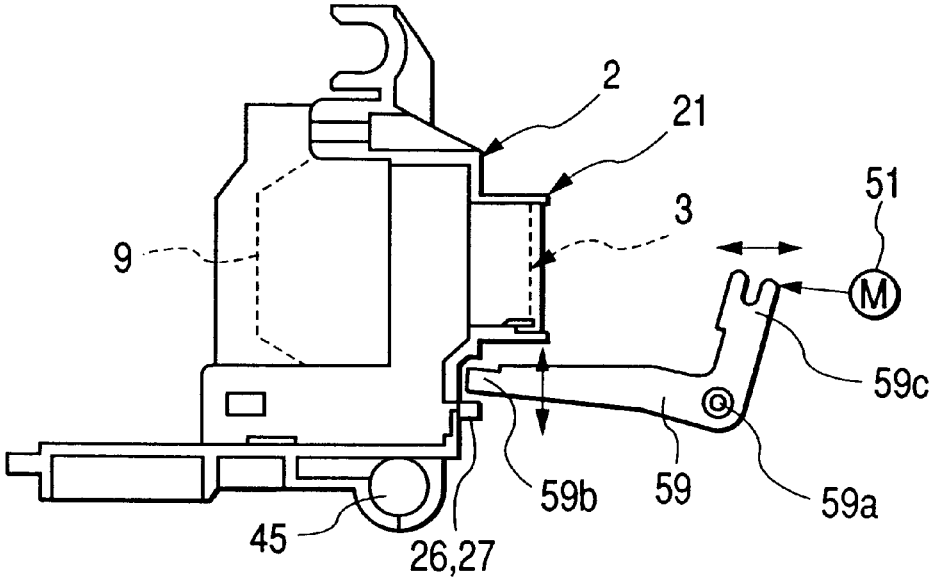
FIG. 3A is a view of the apparatus in FIG. 1 in a state where the carriage lock is disengaged.
Figure 3B:
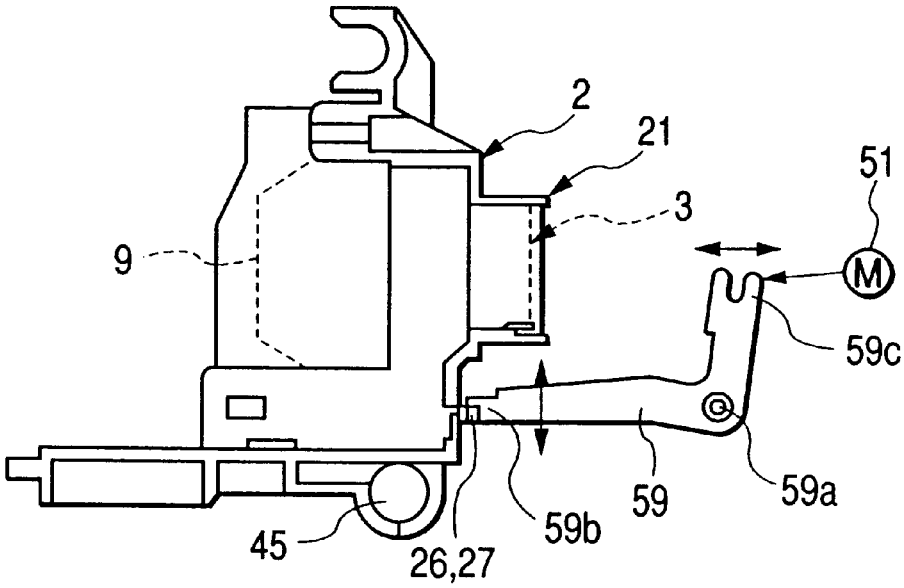
FIG. 3B is a view of the apparatus in FIG. 1 in the locked condition.

In the maintenance unit 5 of this embodiment, the carriage lock mechanism 58 and the ink suction mechanism 55 are driven by a common motor 51, whose rotation direction and rotation displacement control each action of the mechanisms. As shown in FIGS. 3A and 3B, when the rearward end 59*c* of the lock arm 59 moves backward and forward by the motor 51, the lock arm 59 swings around the swinging center pin 59*a*, and the forward end 59*b* moves up and down in association with the swinging movement.

The carriage 2 is provided with a pair of engaging projections 26 and 27 at a determined space 21 in a direction of movement of the carriage. Moving paths of the engaging projections 26 and 27 in association with the movement of the carriage 2 and a swinging path of the forward end 59*b* of the lock arm 59 are set so that both the paths cross with each other. For example, while the carriage 2 is moving in the recording area B to effect the printing, the forward end

59*b* of the lock arm 59 is retreated to an upper position where it does not cross the moving paths of the projections 26 and 27, as shown in FIG. 3A. In contrast, when the carriage 2 has returned to the home position HP after the printing is finished, the forward end 59*b* of the lock arm 59 swings downward placing the forward end 59*b* of the lock arm 59 in the space 21 formed between the projections 26 and 27 as shown in FIG. 3B. As a result, the carriage 2 engages with the lock arm 59, through projections 26 and 27, into a locked condition at the home position HP. To disengage the carriage lock from this locked condition, the forward end 59*b* of the lock arm 59 may be swung again to the upper retreated position.

Referring again to FIG. 2, a drive control system 60 composed mainly of a microcomputer controls the operation of the ink jet recording apparatus 1. The drive control system 60 in this embodiment comprises a carriage controller 65 for controlling the drive of the carriage driving mechanism 4 (motor 42), a maintenance unit drive controller 63 for controlling the drive of the maintenance unit 5 (motor 51), and a timer 62 for measuring the waiting time while the carriage 2 is at the home position HP. This maintenance unit controller 63 is divided into a carriage lock mechanism control part 63A for controlling the drive of the carriage lock mechanism 58, and an ink suction mechanism control part 63B for controlling operation of the ink suction mechanism 55.

The carriage controller 65 actuates the motor 42 so that the printing can be conducted by the recording head 3 in accordance with a printing command transmitted from a host computer, to move the carriage 2 in the recording area B. After printing is finished, the carriage 2 is driven to move to the home position HP.

When a head restoration request is issued from a head restoration requester 64, the carriage controller 65 interrupts the printing (which can occur even during the printing process), and moves the carriage 2 to the home position HP. In this case, the controller 65 need not necessarily respond to the restoration request instantly, but can wait, for example, until the printing is finished, to move the carriage 2 to the home position HP. The head restoration requester 64 may be a manual switch which is provided, for example, on a case of the printer 1 for instructing the head restoring process, or other means for receiving commands from the host computer to request the head restoring process. Moreover, the head restoring process may be executed on the basis of lapse of time and amount of the printing since the previous head restoring process.

The carriage controller 65 receives a signal from a detector 61 for detecting that the carriage 2 has returned to the home position HP. The detector 61 may be, but is not limited to a micro switch. One the detector 61 has determined that the carriage 2 has returned to the home position HP, the waiting time during which the carriage stays at the home position HP is measured by the timer 62. The detector 61 is also used for establishing the position of the carriage 2, when the electric power is applied to initialize the mechanism part.

If a step motor is used for the motor 42 to conduct an open loop control, detection by the detector 61 does not necessarily have to be a trigger to start the measurement by the timer 62. However, in order to ensure the lock of the carriage 2 at the home position, use of the detector 61 is preferable.

If the preset time has expired without receiving any printing command (i.e., the waiting time of the carriage measured by the timer 62 has exceeded the preset time), the carriage lock drive control part 63A of the drive control system 60 actuates the carriage lock mechanism 58 to bring the carriage 2 into the locked condition.

The preset waiting time is set to be 20 seconds in case of a POS printer so as to attain the most efficient carriage lock considering conveniences for the use. If the waiting time is too short, the frequency of the carriage lock is not reduced and the durability is not enhanced. On the contrary, if the waiting time is too long, the period in which the carriage is not locked becomes long which will increase risks of ink leakage due to vibrations, shocks, etc. For this reason, it is preferable to set the waiting time at an appropriate value according to the way of using the relevant printer.

When the head restoration request is issued from the head restoration requester 64, the carriage lock mechanism 58 will be instantly actuated, regardless of the waiting time which puts the carriage 2 in the locked condition. When the carriage is positioned in the printing area B as described above, the carriage controller 65 moves the carriage 2 to the home position at the head restoration request, and then, the carriage lock control part 63A rapidly actuates the carriage lock mechanism 58 to put the carriage 2 in the locked condition. After the carriage 2 has been locked, the ink suction control part 63B actuates the ink suction mechanism 55 to suck the ink through the nozzles 31 of the recording head 3.

The above described parts 65, 63A, 63B and 64 are composed of ROM or the like which stores programs for regulating a microprocessor (CPU) as well as its operations. The above described functions can be realized by driving and controlling the motor 42, 51, etc. according to the programs.

Figure 4:
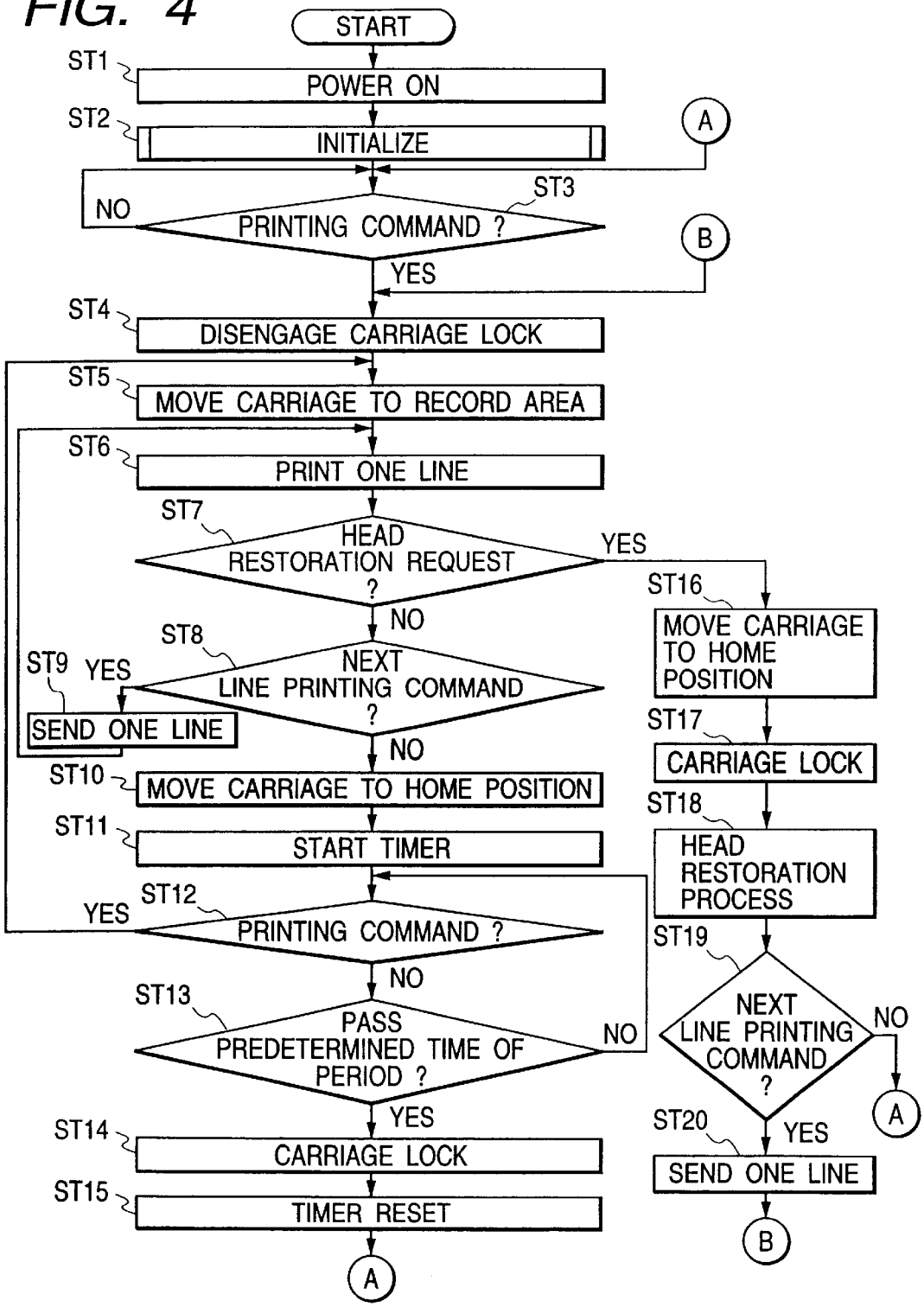
FIG. 4 is a flow chart illustrating the control operations of the carriage lock mechanism of the apparatus as shown in FIG. 1.
Figure 5:
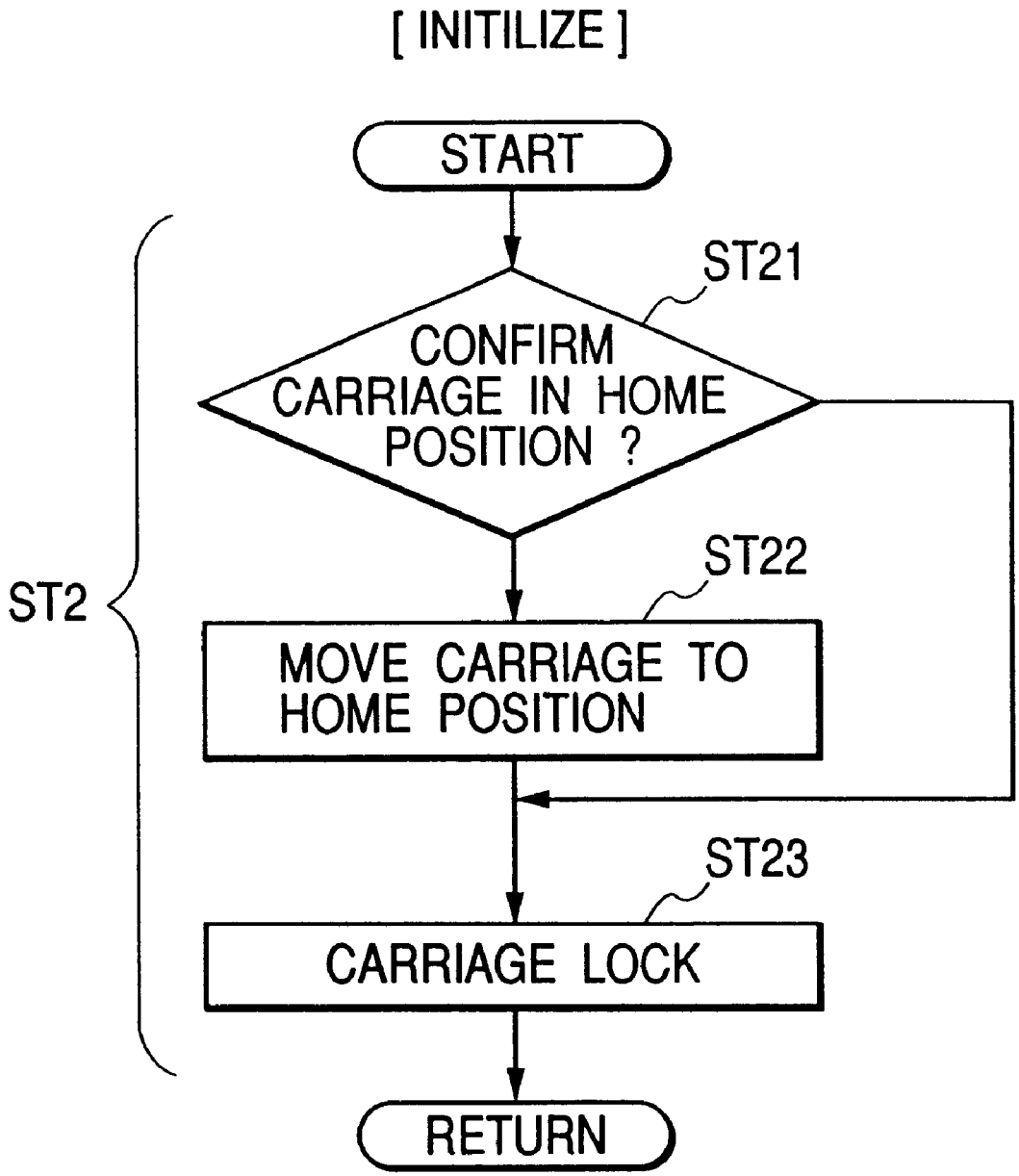
FIG. 5 is a flow chart illustrating the details of the steps in the initialization process in FIG. 4.

FIGS. 4 and 5 are flow charts showing the operation of the ink jet recording apparatus 1 of this embodiment, referring mainly to the carriage lock operation by the carriage lock mechanism. The operation of the carriage lock mechanism will be explained according to these flow charts.

Electric power is supplied in step ST1, and the initializing process begins in step ST2. During the initializing process, it is confirmed in step ST21, as shown in FIG. 5, that the carriage 2 is at the home position HP. If the carriage is at the home position HP, then in step ST23 the carriage lock is performed. If the carriage is not at the home position HP, then the carriage 2 is moved to the home position HP at step ST22 and the carriage lock is performed in step ST23.

In step ST3 the printer waits for printing command. Once the printing command is received, the carriage lock is disengaged in step ST4, and the carriage 2 is moved to the recording area B in step ST5. In steps ST6 and ST7, each time a line has been printed, it is determined whether or not there is the head restoration request. Where no head restoration request has been received, it is determined whether or not there are printing data for the next line in step ST8. If there are printing data, paper is fed for one line and the next line is printed in steps ST9 and ST6, respectively. When printing is detected as finished in step ST8, the carriage 2 is returned to the home position HP in step ST10. In step ST11, counting of the waiting time since the carriage 2 has returned to the home position HP starts. The carriage remains in the home position HP until the preset waiting time has expired, and the carriage 2 waits for the printing command instep ST12.

When the waiting time of the carriage 2 at the home position HP has exceeded the preset waiting time, proceeding to step ST14, the carriage lock is engaged. Then the timer is reset at step ST15 and the process begins again in step ST3.

Where the printing command is received before expiration of the preset waiting time, the carriage lock will not be conducted. In this case, immediately returning to step ST5 from step ST12, the carriage 2 is moved to perform the printing.

Where the head restoration request is issued, shifting from step ST7 to step ST16, the carriage 2 is moved to the home position HP, and the carriage lock is immediately engaged in step ST17. In step ST18, the ink suction mechanism 55 suctions ink, that is, the head restoring process will be conducted.

If the head restoring process is conducted before all the lines have been printed, proceeding from step ST19 to step ST20, after paper is fed for one line, the carriage lock will be disengaged to restart the printing process after step ST5. If there is no printing data for the next line at step ST19, then the printing command is awaited in step ST3 with the carriage lock maintained.

Situations in which head restoration requests are issued include but are not limited to the following reasons: the waiting time since the previous ink suction process has exceeded the preset time; and a manual operating member is switched on where the ink suction action can be actuated by manual operation.

In this embodiment, the lever is driven by the motor. The invention is not limited by this embodiment. It is capable for employing an electromagnetic lock mechanism such the solenoid (electromangent)is used as a driving source, and the lock condition is maintained when the power is cut off.

A number of embodiments of the present invention have been described. Nevertheless, it will be understood that various modifications may be made without departing from the spirit and scope of the invention. Accordingly, other embodiments are within the scope of the following claims.

What is claimed is:

1. An ink jet recording apparatus comprising:

a recording head for ejecting ink liquid drops; a carriage for carrying said recording head and adapted to translate between a recording area and a home position;

a carriage lock mechanism for locking said carriage at said home position;

a carriage controller for translating said carriage to said home position;

a timer for measuring a waiting time during which said carriage is at said home position; and a lock controller which allows said carriage lock mechanism and said carriage to be put into a locked condition when said waiting time measured by said timer has reached or exceeded a predetermined time.

2. An ink jet recording apparatus as claimed in claim 1, wherein said carriage controller is adapted to translate said carriage from said home position to said recording area according to a printing command, and to translate said carriage to said home position after a printing process.

3. An ink jet recording apparatus as claimed in claim 1, further comprising:

an ink suction mechanism for sucking ink through nozzles in said recording head and discharging it to the exterior to restore said recording head; and a head restoration requester for requesting a head restoration by said ink suction mechanism, wherein said lock controller drives said carriage lock mechanism so as to lock said carriage at said home position regardless of said waiting time when receiving said head restoration.

4. An ink jet recording apparatus as claimed in claim 2, further comprising:

an ink suction mechanism for sucking ink through nozzles in said recording head and discharging it to the exterior to restore said recording head; and a head restoration requester for requesting a head restoration by said ink suction mechanism, wherein said lock controller drives said carriage lock mechanism so as to lock said carriage at said home position regardless of said waiting time when receiving said head restoration.

5. An ink jet recording apparatus of claim 1, wherein said lock controller drives said carriage lock mechanism regardless of the waiting time, immediately after a driving power has been applied, to lock said carriage at said home position.

6. An ink jet recording apparatus of claim 3, wherein said lock controller drives said carriage lock mechanism regardless of the waiting time, immediately after a driving power has been applied, to lock said carriage at said home position.

7. An ink jet recording apparatus of claim 1, further comprising:

a detector for detecting that said carriage has been translated to the home position, said timer measuring the waiting time on the basis of results of detection by said detector.

8. An ink jet recording apparatus of claim 5, further comprising:

a detector for detecting that said carriage has been translated to the home position, said timer measuring the waiting time on the basis of results of detection by said detector.

9. A method for controlling an ink jet recording apparatus comprising a recording head for ejecting liquid ink drops, a carriage carrying said recording head and adapted to translate between a recording area and a home position, and a carriage lock mechanism for locking said carriage at said home position, the method comprising the steps of:

(a) translating the carriage from the home position to the recording area according to a printing command;

(b) translating said carriage to said home position after a printing is finished;

(c) measuring a waiting time during which said carriage stays at said home position after said step (b);

(d) driving said carriage lock mechanism when said waiting time has reached a predetermined time, to lock said carriage at said home position.

10. The method of claim 9, wherein said ink jet recording apparatus further comprises an ink suction mechanism for restoring said recording head by sucking ink through ink nozzles of said recording head and discharging it in response to a head restoration request, said method further comprising a step of:

(e) driving said carriage lock mechanism regardless of said waiting time, to lock said carriage at said home position, when receiving said head restoration request.

11. The method of claim 9 further comprising a step of:

(e) interrupting measurement of said waiting time, on receiving the printing command again within said preset time, in the previous step (d), and translating said carriage from said home position to said recording area.

12. The method of claim 11, wherein said ink jet recording apparatus further comprises an ink suction mechanism for restoring said recording head by sucking ink through ink nozzles of said recording head and discharging it in response to a head restoration request, disposing it to the exterior, said method further comprising a step of:

(f)driving said carriage lock mechanism regardless of said waiting time to lock said carriage at said home position, when receiving said head restoration request.

13. The method of claim 10, further comprising a step of:

(b2) prior to said step (e), translating said carriage to said home position in response to said head restoration request, if said carraige is not in said home position.

* * * * *